United States Patent [19]

Solheim et al.

[11] 4,453,717

[45] Jun. 12, 1984

[54] PUTTING PRACTICE DEVICE

[75] Inventors: Karsten Solheim, Phoenix, Ariz.; N. Eugene Cotchonis, Sherman Oaks, Calif.

[73] Assignee: Karsten Manufacturing Corp., Phoenix, Ariz.

[21] Appl. No.: 417,408

[22] Filed: Sep. 13, 1982

[51] Int. Cl.[3] ..... A63B 69/36

[52] U.S. Cl. ..... 273/192; 273/183 A

[58] Field of Search ..... 273/192, 191 R, 191 A, 273/191 B, 186 R, 186 C, 183 A, 187 R, 187 A, 187 B

[56] References Cited

U.S. PATENT DOCUMENTS

| | | | |
|---|---|---|---|
| 2,776,836 | 1/1957 | Zadina | 273/192 |
| 3,899,180 | 8/1975 | Rodman | 273/192 |
| 3,934,874 | 1/1976 | Henderson | 273/192 X |

FOREIGN PATENT DOCUMENTS

| | | | |
|---|---|---|---|
| 218526 | 5/1957 | Australia | 273/192 |
| 301646 | 12/1928 | United Kingdom | 273/192 |

*Primary Examiner*—George J. Marlo

*Attorney, Agent, or Firm*—Herbert E. Haynes, Jr.

[57] ABSTRACT

An apparatus for practicing golf putting strokes including a putting surface member for receiving a golf ball to be putted and a swing path defining member which extends angularly from the putting surface part and lies in a plane which defines a normal and desired putter swing path. The swing path defining part is laterally offset from the intended swing path of the putter to provide a person using the apparatus with a visual indication of a normal swing path to serve as a guide while making unfettered practice swings with the putter. The swing path defining member includes an unobstructed planar member and a flange which is mounted on the putting surface member and supports the unobstructed planar member at an angle of substantially 72° with respect to the putting surface member.

9 Claims, 5 Drawing Figures

PUTTING PRACTICE DEVICE

BACKGROUND OF THE INVENTION

1. Field of the Invention

This invention relates generally to golf swing practice devices and more particularly to a device for aiding a golfer in perfecting his putting stroke.

2. Description of the Prior Art

The importance of proper putting in the game of golf has long been known, and just how important that phase of the game is will be appreciated on consideration of the fact that approximately 50% of the strokes used in completing a round of golf on a par 72 regulation length 18 hole golf course are for putting alone. In addition, putting for most players is one of the most, if not the most, difficult golfing skills to master, and provides a constant challenge even to the most skillful players.

The basic problem in putting is that of perfecting a natural swing that will place the face of a putter's head square, that is perpendicular, with the intended path of travel of a ball at the time of impact therewith, and of mastering such a swing so that it is repeated each time the player putts. Although seemingly a simple procedure, the putting stroke must be precise and made within extremely narrow limits. The slightest deviation in the direction of travel of the club head in its approach to the ball, or any deviation from the perpendicular attitude of a club head to the intended travel path of the ball during the time of impact, will cause the ball so struck to deviate from the desired path.

Most golfers are well aware of the fundamental precision required in putting, and they attempt to achieve the required precision by applying various elements of form recommended by professionals, and the like, in executing the stroke. Among these procedures are proper club grip, stance, backswing, downswing, and follow through. Essentially, golfers practice the appropriate combination of these elements until they become natural, and thus repeatable. Nevertheless, there is a basic misconception among many golfers, and even among some professionals, as to the proper technique of putting. This misconception involves the backswing and downswing, which many believe should be in a path coincident with the intended travel path of the struck golf ball. Further, it is believed that a club head should be kept perpendicular with the intended travel path of the ball at all times during the putting stroke. This type of swing, however, is unnatural due to the nature of human anatomy and mastering an unnatural swing to achieve any degree of repeatability is very difficult.

An example of a putting stroke practice device based on the theory discussed above can be found in U.S. Pat. No. 4,230,319, issued on Oct. 28, 1980, to M. E. Lindner. This practice device fetters or restrains the path of a head of a putter in a path directly along the intended path of travel of a golf ball to be struck as opposed to allowing a swing in a natural arc.

SUMMARY OF THE INVENTION

It is an object of the present invention to provide an apparatus for practicing golf putting strokes which permits a putter head to follow an arc reflecting a natural swing.

It is another object of the present invention to provide an apparatus for practicing golf putting strokes which permits a natural swing in an unrestrained arc.

Still another object of the present invention is to provide an apparatus for practicing golf putting strokes which is easily convertible for use by either right handed or left handed players.

A still further object of the present invention is to provide an apparatus for practicing golf putting strokes which can be adjusted to permit practicing of line-of-stroke swings if so desired.

These and other objects are achieved according to the present invention by providing apparatus for practicing golf putting strokes comprising a putting surface part for receiving a ball to be putted, and a putter head guide part associated with the putting surface part for permitting a putter head to follow unfettered an arc reflecting a natural swing. The putting surface part forms a substantially planar first surface, with the guide part forming a substantially planar second surface arranged extending at a predetermined angle relative to the first surface. The latter preferably is arrangable in a substantially horizontal plane, such that the second surface is disposed extending from the first surface at, for example, an angle of approximately 18° to a line perpendicular to a substantially horizontal plane of the first surface.

The putting surface part advantageously includes a planar member forming a straight edge having extending therefrom an upstanding ledge arranged for partially forming a trough in conjunction with the planar member for receiving a head of a golf putter. Provided on the planar member of the putting surface part is a detent arrangement which restrains a golf ball from movement until struck by a putter head.

The guide part preferably includes a planar sheet defining a longitudinal edge from which a flange depends at an angle permitting abutting relationship of the flange with an upper surface of the planar member of the support surface part of the apparatus. A suitable fastener assembly releasibly attaches the flange of the planar sheet to the planar member of the support surface part at a point spaced from the ledge extending upwardly from the planar member and arranged for cooperating with the ledge to form the aforementioned trough which receives a head of a putter, and the like. Preferably, the angle between the flange and the planar sheet of the guide part is approximately 72°, for example.

The fastener assembly advantageously includes two pairs of holes formed in the flange of the guide part so as to selectively cooperate with a pair of matching apertures formed in the planar member in order to adjust the apparatus for either left handed or right handed golfers.

A wedge-shaped element is advantageously included with the apparatus for selectively being inserted between the flange of the guide part and the planar member of the support surface part for changing the angle between the planar member and the planar sheet to, for example 90° in order to permit practice of line-of-stroke swings if so desired.

A principle advantage of the present invention is that it permits putts to be practiced with a natural arc swing as opposed to a line-of-stroke swing.

Another advantage of the present invention is that it can accomodate in a simple manner either left handed or right handed players.

Yet another advantage of the present invention is that it can be used on any suitable surface, either indoors or outdoors, as desired.

The foregoing and other objects of this invention, as well as the invention itself, may be more fully understood when read in conjunction with the following drawings.

DESCRIPTION OF THE PREFERRED EMBODIMENTS

Figure 1:
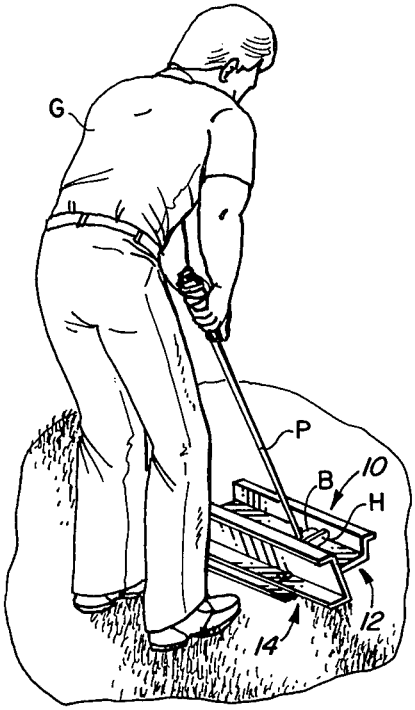
FIG. 1 is a diagrammatic, perspective view showing the manner in which practice apparatus according to the present invention can be utilized.

Referring now more particularly to FIG. 1 of the drawing, apparatus 10 according to the present invention for practicing golf putting strokes comprises a putting surface part 12 arranged for receiving a ball B to be putted, and a putter head guide or path defining part 14 associated with part 12 for permitting a head H of a putter P to follow unfettered an arc reflecting a natural swing when moved by a golfer G. As can be seen putting surface part 12 forms a substantially planar first surface while path defining part 14 forms a substantially planar second surface arranged extending at a predetermined angle related to the first surface.

Figure 2:
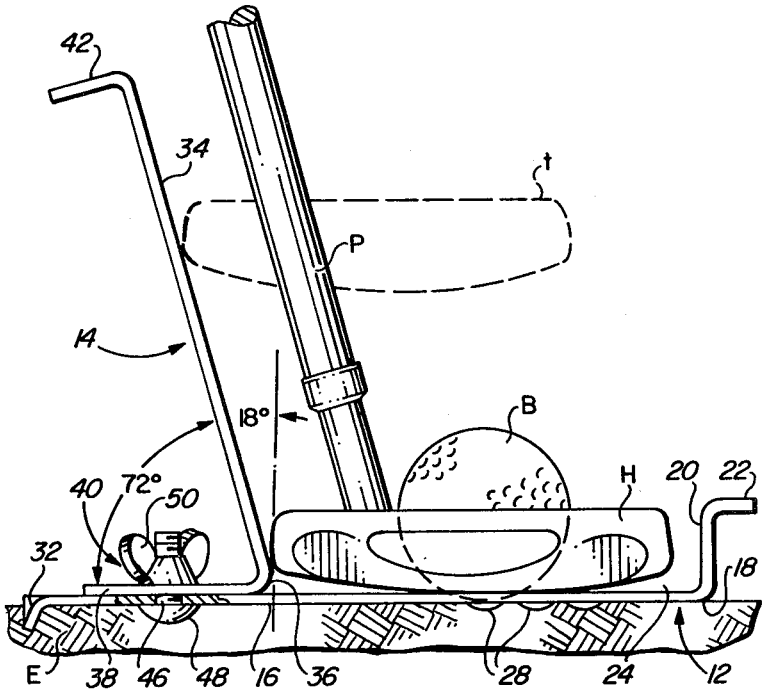
FIG. 2 is an end elevational view, partically in section, showing putting practice apparatus according to the present invention.

Putting surface part 12 includes a planar member 16 constructed from a suitable material, such as sheet metal, and the like, forming a straight edge 18 along one side thereof from which extends an upstanding ledge 20 terminating in a lip 22 generally coplanar with member 16. Ledge 20 partially cooperates with member 16, and with guide part 14 to be discussed below, to form a trough 24 arranged for receiving a head H of a putter P as seen in FIG. 2.

Provided on an upwardly facing surface of planar member 16 is a detent arrangement 26, 26' including a plurality of side-by-side dimples 28, 28' capable of restraining a golf ball B from movement prior to being struck by head H of a putter P. The reason for duplication of the detent arrangement 26, 26' is to permit adjustment, in a manner to be described in detail below, of apparatus 10 for use by either left handed or right handed golfers. Associated with dimples 28, 28' are grooves 30, 30', respectively, extending transversely of the trough 24 portion of part 12 to act as a guide for squaring a putter, or bringing it perpendicular to the intended travel path of a ball when lining up a shot.

The edge of planar member 16 parallel to but spaced from edge 18 is provided with a downwardly extending rib 32 which can form a slight point as illustrated for penetration into a carpet, ground, or other suitable surface having sufficient give in order to anchor member 16 on the associated surface, earth E as illustrated, and prevent apparatus 10 from movement during use.

Putter head path defining part 14 includes a planar sheet 34, also constructed from sheet metal, and the like, defining a longitudinal edge 36 from which depends at an appropriate angle, 72° as illustrated, a flange 38. As best seen in FIG. 2, flange 38 abuts the upper surface of planar member 16 adjacent the edge thereof from which rib 32 depends, and is removably attached to member 16 by a fastener assembly 40. The uppermost edge of sheet 34, that being the edge spaced from edge 36, advantageously terminates in a downwardly turned rim 42 so as to strengthen sheet 34 and prevent warpage thereof.

By using the illustrated angle of 72° between flange 38 and sheet 34, the latter will have an angle relative to a perpendicular extending upwardly from the upper surface of member 16 of approximately 18°, which angle has been found to provide a natural swing plane when a putter head H is moved along the upwardly facing surface of sheet 34.

Figure 3:
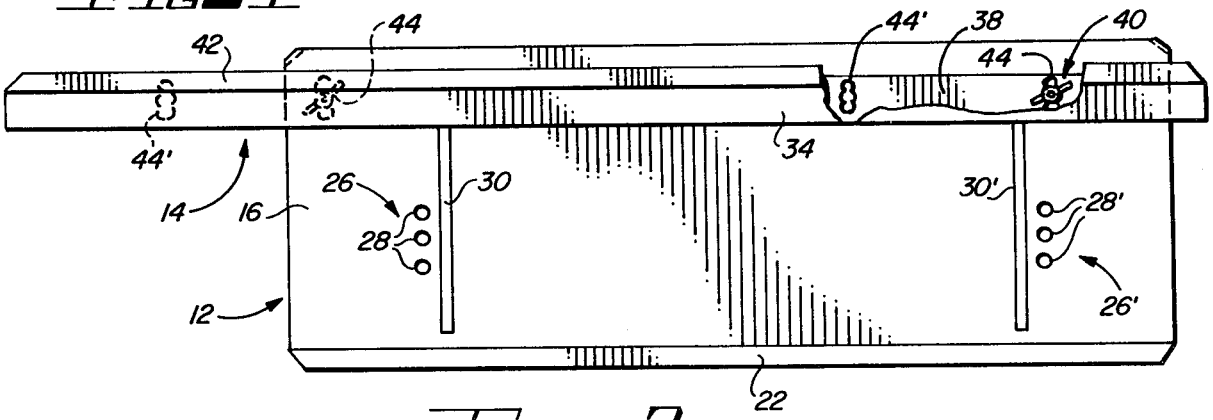
FIG. 3 is a top plan view, partly broken away and in section, of the apparatus seen in FIG. 2, but with the putter and golf ball shown in FIG. 2 removed for clarity.

Fastener assembly 40 includes two pair of holes 44, 44' formed in flange 38, and a pair of apertures 46 formed in the portion of planar member 16 disposed near the edge in which rib 32 is provided spaced to match either of the pairs of holes, 44, 44' in order to selectively cooperate with one pair of same and accomodate either right handed or left handed golfers by moving guide part 14 longitudinally relative to surface part 12. Suitable fasteners such as the illustrated bolts 48 and cooperating wingnuts 50 can be employed to releasibly retain guide part 14 in a desired relationship with respect to surface part 12. As illustrated in FIGS. 1 through 3, apparatus 10 is set-up to accomodate a right handed player. By moving guide part 14 with the respect to surface part 12 such that holes 44' register with apertures 46, it will be appreciated that a left handed golfer can use apparatus 10 by placing a ball B on one of the dimples 28' of detent arrangement 26' in a manner not shown.

As shown in FIG. 3, the holes 44 and 44' are elongated which allows adjustable positioning of the path defining part 14 relative to the ledge 20 of the putting surface part 12. Such adjustable positioning is advantageous in that it allows putter heads of different lengths, i.e., the distance between the heel and toe of the head, to be used in the apparatus 10. This adjustable feature accounts for the aligned plural dimples 28, 28' of the detent arrays 26, 26' provided on the upwardly facing surface of the putting surface part 12, which allow the ball B to be properly placed at the sweet spot of the variously sized putter heads usable in conjunction with the apparatus 10.

Figure 4:
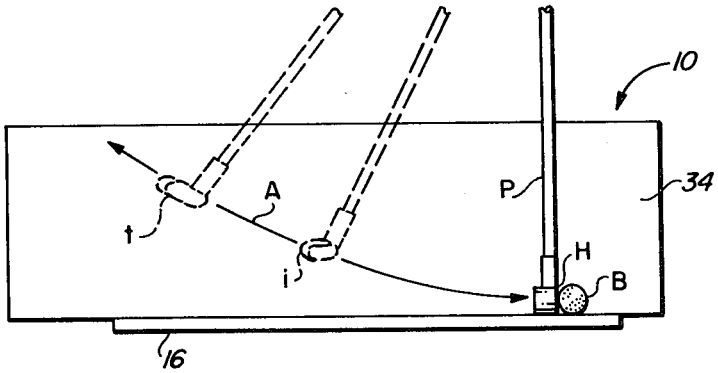
FIG. 4 is a diagrammatic, front elevational view illustrating the natural arc achieved by a putter swing when using the apparatus according to the present invention.

Referring now to FIG. 4 of the drawings, wherein the arcuate path A, that the head H of the putter P will take when swung, is illustrated diagrammatically. As is apparent from the arcuate path A when swung, the putter head H will be elevated relative to the putting surface part 12 during the backswing and will return to the putting surface part 12 during the downswing. This is apparent from the putter head positions illustrated in phantom lines in FIG. 4, with the position i being an intermediate position of a backswing or downswing and the position t being indicated of the top of the backswing. However, it will be noted that when a natural swing is made, the arcuate path A will be in a plane which is parallel to the planar sheet 34 of the path defining part 14, as indicated by the putter head position t in FIG. 2, and that maintaining such parallelism is important in teaching and/or mastering a proper putting stroke. Therefore, when utilizing the apparatus 10 of the present invention, the golfer G may place the heel of the putter head H in engagement with the slanted outwardly facing surface of the planar sheet 34, as shown in FIG. 2, and maintain such engagement throughout the backswing and downswing portions of the putting stroke. In this manner, the golfer will get the feel of a natural swing. It will be appreciated however, that since the sheet 34 defines the plane of a natural putting stroke, the above discussed engagement of the putter head H with the sheet 34 is not essential in that a simple visual indication of the proper swing plane will aid the golfer in mastering proper execution of the proper putting stroke.

By configuring the apparatus 10 as hereinbefore described, a putting stroke which deviates excessively from the natural swing plane may cause the putter head H to move into contact with either the upstanding ledge 20 of the putting surface part 12 or the slanted sheet 34 of the path defining part 14, thus correcting such an improper swing.

Accordingly, the apparatus 10 can train one to putt with a natural swing plane in a simple and efficient manner, without necessarily fettering any part of the putter being used.

Figure 5:
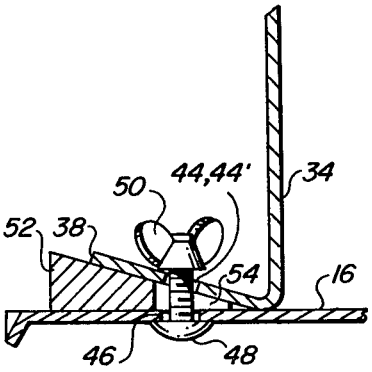
FIG. 5 is a fragmentary, transverse sectional view of the apparatus seen in FIGS. 2 and 3, but with a wedge-shaped element added for changing the angle between the guide part and ball support part of the device.

As can be seen from FIG. 5 of the drawings, a wedge-shaped element 52 having a slot 54 extending inwardly from the pointed end thereof can be selectively inserted between flange 38 and planar member 16 for changing the angle between member 16 and planar sheet 34 to, for example, approximately 90° as illustrated. Element 52 can be retained in place by use of the aforementioned fasteners which attach flange 38 to member 16. More specifically, a bolt 48 can pass through an aperture 46, slot 54 of element 52, and either a hole 44, 44', as appropriate, to be retained in place by a wingnut 50, and the like. Either element 52 can be made sufficiently long to extend between a pair of holes 44 or 44', with a pair of slots 54 spaced appropriately, or a pair of elements 52, each provided with a slot 54, can be used as desired.

As can be readily understood from the description above and from the drawings, putting practice apparatus according to the present invention permits one to develop a natural arc putting stroke in a simple and efficient manner without actually fettering or restraining the putter. As long as the user of the apparatus is stroking with a natural swing, no part of the apparatus will necessarily be contacted. If, however, the user's swing deviates excessively from a natural swing, the apparatus will be contacted by the head of the putter, thus correcting the swing.

While it has been indicated above that the apparatus can be constructed from sheet metal, and the like, it is to be understood that the device can be constructed in any suitable known manner from any suitable material, such as a suitable synthetic resin. Further, the manner of attachment of the surface part and guide part to one another can be varied, such as by using different bolt fasteners, slot-and-tab class of attachment and arrangements, or any other suitable mode of attachment, none of which are shown. Further, adhearance of the surface part of the apparatus to an associated supporting surface can be accomplished in any suitable manner, such as by suitable, known suction devices (not shown) which could adhear the apparatus to a tile floor or other suitable hard surface.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. Apparatus for practicing golf putting strokes comprising in combination:

(a) a putting surface member of elongated planar configuration defining a golf ball receiving area and indicating the intended travel path of a golf ball to be putted, said putting surface member having an opposed pair of longitudinal edges; and (b) a swing path defining member including an elongated unobstructed planar surface member and a flange of integral one piece construction which extends angularly from one of the longitudinal edges of said unobstructed planar surface member to form a fixed included angle of substantially 72°, said flange being mounted contiguously on said putting surface member to support said unobstructed planar surface member in a natural putter swing plane of substantially 72° with respect to said putting surface member, said flange being adjacent one of the longitudinal edges of said putting surface member to laterally space said unobstructed planar surface member out of the intended natural swing path of a putter to be used so that said unobstructed planar surface member will serve as a disengaged visual indication of the intended natural swing path of a putter to be used.

2. Apparatus as claimed in claim 1 wherein the unobstructed planar surface of said swing path defining member extends angularly upwardly and away from the opposite longitudinal edge of said putting surface member at an angle of substantially 18° with respect to a perpendicular to said putting surface member.

3. Apparatus as claimed in claim 1 and further comprising detent means in the putting surface member intermediate said swing path defining member and the opposite longitudinal edge of said putting surface member for resisting unintentional movement of the golf ball receivable thereon.

4. Apparatus as claimed in claim 1 wherein said putting surface member is arrangeable on a supporting surface in a substantially horizontal attitude and comprises:

(a) a planar sheet of elongated configuration for receiving the golf ball to be putted and having the opposed longitudinal edges of said putting surface member; and (b) an upstanding ledge on the opposite longitudinal edge of said planar sheet for cooperating with said swing path defining member to form a trough for receiving the head of a putter and allowing the putter to be freely swung in the trough.

5. Apparatus as claimed in claim 4 and further comprising means depending from said planar sheet of said putting surface member for engaging the supporting surface upon which said putting surface member is arrangeable and resisting unintentional movement of said planar sheet.

6. Apparatus as claimed in claim 4 wherein said swing path defining member is transversely relocatable on said planar sheet of said putting surface member toward and away from said ledge for adjusting the width dimension of said trough to allow various lengths of putter heads to be received and freely swung therein.

7. Apparatus as claimed in claim 4 wherein said swing path defining member is longitudinally relocatable on said planar sheet of said putting surface member between a first longitudinal position which is suitable for use by a right handed golfer and a second longitudinal position which is suitable for use by a left handed golfer.

8. Apparatus as claimed in claim 7 and further comprising:

(a) first detent means in said planar sheet of said putting surface member proximate one of the ends thereof for receiving a golf ball to be putted by a right handed golfer when said swing path defining member is in the first longitudinal position thereof; and (b) second detent means in said planar sheet of said putting surface member proximate the opposite end thereof for receiving a golf ball to be putted by a left handed golfer when said swing path defining member is in the second longitudinal position thereof.

9. Apparatus as claimed in claim 1 and further comprising wedge means insertable between said flange of said swing path defining member and said putting surface member for changing the angular disposition of said swing path defining member to a normal attitude with respect to the putting surface member.

* * * * *